US005497950A

United States Patent [19]

Schrödl

[11] Patent Number: 5,497,950

[45] Date of Patent: Mar. 12, 1996

[54] ROTOR FOR A DISINTEGRATING MACHINE

[76] Inventor: Hermann Schrödl, Vornwald 7, A-4713 Gallspach, Austria

[21] Appl. No.: 273,233

[22] Filed: Jul. 11, 1994

[30] Foreign Application Priority Data

Jul. 12, 1993 [AT] Austria ..... 1366/93

[51] Int. Cl.[6] ..... B02C 13/28

[52] U.S. Cl. ..... 241/191; 241/189.1; 241/195; 241/294

[58] Field of Search ..... 241/188.1, 189.1, 241/191, 195, 294

[56] References Cited

U.S. PATENT DOCUMENTS

| | | | |
|---|---|---|---|
| 1,189,471 | 7/1916 | Ochterbeck | 241/189.1 |
| 1,889,129 | 11/1932 | Nielsen | 241/195 |
| 2,378,475 | 6/1945 | Gruender et al. | 241/191 |
| 3,784,117 | 1/1974 | Koenig et al. | 241/191 |
| 4,688,731 | 8/1987 | Hunt et al. | 241/191 |
| 4,717,083 | 1/1988 | Quast et al. . | |
| 4,826,090 | 5/1989 | Orphall et al. | 241/294 X |
| 4,915,309 | 4/1990 | Schmidt | 241/191 |
| 5,320,292 | 6/1994 | Smith | 241/191 |
| 5,395,063 | 3/1995 | Schrödl | 241/191 |

FOREIGN PATENT DOCUMENTS

| | | | |
|---|---|---|---|
| 2440779 | 6/1980 | France . | |
| 956188 | 1/1957 | Germany | 241/191 |
| 3204629 | 8/1983 | Germany | 241/195 |
| 3525442 | 1/1987 | Germany | 241/191 |
| 2110113 | 6/1983 | United Kingdom . | |
| 2110954 | 6/1983 | United Kingdom | 241/191 |

*Primary Examiner*—Timothy V. Eley
*Attorney, Agent, or Firm*—Collar & Roe

[57] ABSTRACT

A rotor for use in a disintegrating machine comprises a rotor body adapted to be rotated about its axis and provided at its periphery with a plurality of receptacles extending parallel to the axis, each receptacle having on one side an opening facing in the direction of rotation. The rotor further comprises a plurality of beater bars, each of which has a bar body extending in a direction which is parallel to the axis and has a symmetrical cross-section. Each bar body has at least one retaining extension supported in a respective receptacle, has a longitudinal plane of symmetry extending in a direction which is substantially parallel to a tangent to a flight circle defined by an outer periphery of the bar bodies of the beater bars upon rotation of the rotor body, and is provided with axially spaced apart knife edges which protrude at the periphery to be contiguous to the flight circle, are symmetrical to the plane of symmetry and extend in planes which are normal to the axis.

14 Claims, 4 Drawing Sheets

ROTOR FOR A DISINTEGRATING MACHINE

BACKGROUND OF THE INVENTION

1. Field of the Invention

This invention relates to a rotor for a disintegrating machine, which comprises peripheral receptacles for supporting beater bars, which are parallel to the axis of the rotor and comprise a bar body that has a symmetrical cross-section, and comprise retaining extensions, which extend into the receptacles of the rotor, and relates also to the beater bars themselves.

2. Description of the Prior Art

Known rotors for disintegrating machines are provided with radially extending receptacles for inserted beater bars, which so extend in said receptacles that the plane of symmetry of each beater bar extends approximately radially. As a result, the beater bars, which owing to their rotation impinge on the material to be disintegrated, are stressed substantially transversely to the plane of symmetry and the rotor must be provided with stable backing structures for the beater bars in order to take up the resulting tilting moments and striking forces. That requirement involves a considerable structural expenditure and because the beater bars must be free to act in the striking direction it is difficult to provide the required space and arrangement. Beater bars are used which have substantially beamlike bar bodies, which only by a specific cross-sectional shape can be adapted to different requirements imposed by the material to be disintegrated and regarding the disintegrating performance and this is unsatisfactory particularly with relatively small machines which can be used for numerous purposes.

SUMMARY OF THE INVENTION

It is an object of the invention to eliminate said disadvantages and to provide a rotor which is of the kind described first hereinbefore and distinguishes by having a relatively simple structure, a high performance, a high adaptability, and not least an economical operation.

That object is accomplished in accordance with the invention in that the receptacles of the rotor are open in the direction of rotation of the rotor and the beater bars extend in the receptacles of the rotor so that the plane of symmetry of the bar bodies is approximately parallel to a tangent on the flight circle of the rotor, and the bar body is provided with protruding axis-normal knife edges, which is defined by an outer periphery of the bar bodies of the beater bars upon rotation of the rotor body, which are symmetrical to the plane of symmetry of the associated bar body and extend in planes which are normal to the axis of the rotor. For this reason said beater bars are supported in the receptacles of the rotor substantially in the direction in which load is applied to the beater bars so that they will not be subjected to substantial tilting moments under the action of the striking force and the bars can be supported in a desirable manner. Besides, the disintegrating action of the beater bars is strongly improved by the axis-normal knife edges, so that the cross-sectional shape of the bar bodies, on the one hand, and the number and arrangement of the knife edges, on the other jand, permit an optimum adaptation of the disintegrating action to various conditions. Besides, the symmetry of the beater bars and their knife edges permits their use in two positions, which are angularly spaced through 180° with respect to the plane of symmetry, so that the useful lives of the beater bars can virtually be doubled because when the beater bar has been worn in one position a beater bar which is virtually unworn in the other position will be available.

If the knife edges have a recess or are interrupted adjacent to the plane of symmetry, it will be possible to restrict the wear to one-half of each knife edge during a use of the beater bars in the one position so that the beater bar will be fully effective when it is subsequently used in the other position. Besides, the shapes of the recessed or interrupted knife edges are more desirable regarding the impact and cleaving actions because the knife edges are formed with corners or strongly curved portions so that higher pressures per unit of surface area will be applied as the knife edges impinge on the material to be disintegrated and the disintegrating action will thus be increased. The recesses or interruptions of the knife edges may have various configurations and in particular may be U- or V-shaped and will suitably be combined with bar bodies having a similar shape in cross-section.

The action of the beater bars may also be adapted to given conditions in that axially extending knife edges are provided on the bar body between the axis-normal knife edges and/or the knife edges are provided with chisellike striking spikes, so that a high disintegrating performance can be achieved.

If the axis-normal knife edges slope toward the bar body at their outer ends, said knife edges at the outer periphery will extend along the flight circle of the rotor and a substantial wear of said end portions will be avoided whereas the action will not be decreased.

The beater bars may be held in the receptacles of the rotor by various clamping and fixing means. For instance, the retaining extension may have a cross-section which is dovetaillike or enlarged like a mushroom and is inserted in and interlocks with undercut guides of the receptacle of the rotor. Wedge-shaped backing surfaces defining the receptacles together with wedge drives and clamping drives may effect a suitable retention of the retaining extensions of the beater bars and in most cases it will be sufficient to provide one longitudinally extending retaining extension per beater bar, although two or more parallel retaining extensions and correspondingly shaped receptacles of the rotor may be provided. But it will be particularly desirable to permit the beater bars to be locked in the receptacles of the rotor by locking rods, which are parallel to the axis of the rotor and fit longitudinally extending grooves formed in the retaining extensions and backing surfaces which define the receptacles and conform to the locking rods. In that case a positive joint between the retaining extension and the receptacles can be made in the receptacles by means of the locking rods and that positive joint will be eliminated when the locking rods are removed so that the beater bars can then freely be removed. As a result, the beater bars can be locked and released by a few manipulations and the beater bars can tangentially be inserted into and removed from the rotor.

Another desirable support will be achieved if the beater bars have transversely extending retaining extensions, which have an enlarged head portion, and the receptacles of the rotor define approximately radially extending receiving grooves, which are undercut to fit the retaining extensions, because in that case the beater bars can simply radially be inserted whereas they still extend in the direction in which they strike.

The parts can be fixed in position by the provision of lugs or other closures for the receiving grooves but it will be desirable to provide the retaining extensions and the surfaces of the receptacles with grooves or openings which extend along the plane of symmetry and fit respective longitudinally extending locking bars so that a locking can be effected simply in that a locking bar is inserted. Such positive joints made by means of a locking bar will be particularly suitable if the beater bars do not integrally extend throughout the axial length of the rotor but are divided in their longitudinal direction into two or more parts; it will be possible to use a locking bar which is continuous or one which is also divided.

A particularly simple design will be achieved if the rotor comprises axially extending backing plates, which are disposed between radial cheeks and at least in part define the receptacles formed in the rotor for the beater bars. This will result in a structure which is rugged but relatively light in weight and in which the axially continuous backing plates support the beater bars throughout their length and substantially without a bending moment. If the backing plates are properly arranged it will be possible to optimally adapt the cross-sectional shape of the rotor to the tangentially extending beater bars whereas the strength of the rotor will not be decreased.

If the basic shape of the rotor consists of a cylinder having a substantially elliptical cross-section, the rotor will have a shape which is particularly suitable for the use of two diametrically opposite beater bars because those beater bars which are disposed in the narrower portions of the cross-section will be exposed to strike in a large area, and the rotor will be light in weight and material will be saved.

DETAILED DESCRIPTION OF THE PREFERRED EMBODIMENTS

Figure 1:
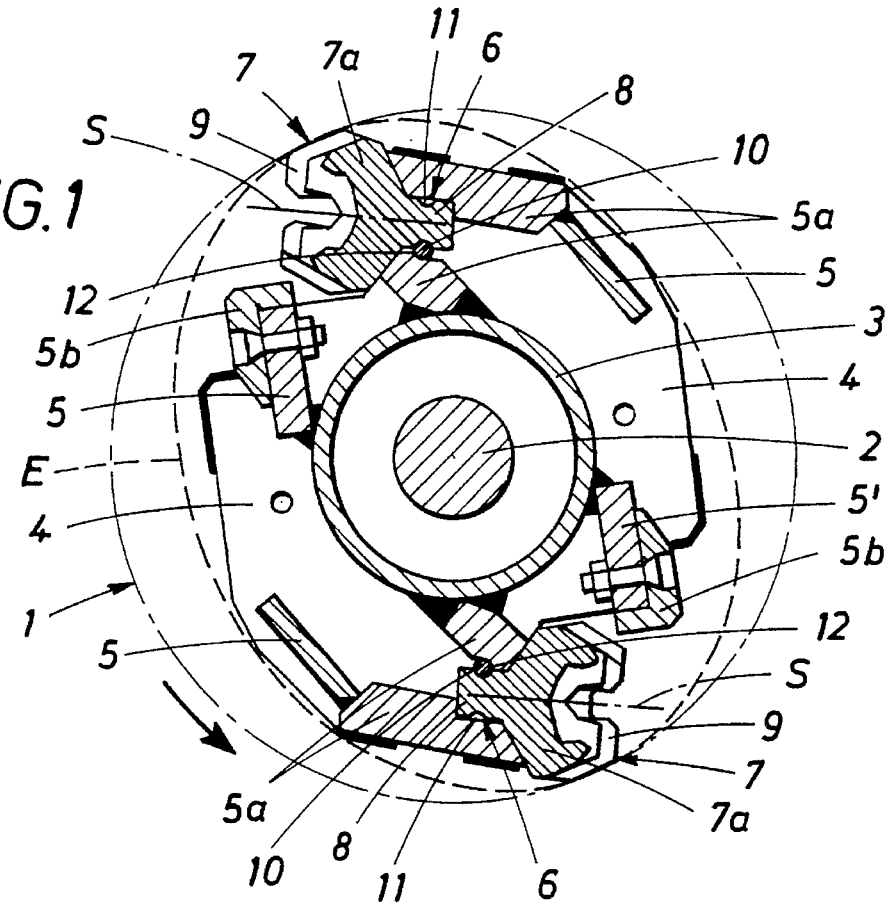
FIGS. 1 and 2 are, respectively, a transverse sectional view and a top plan view showing a rotor in accordance with the invention.
Figure 2:
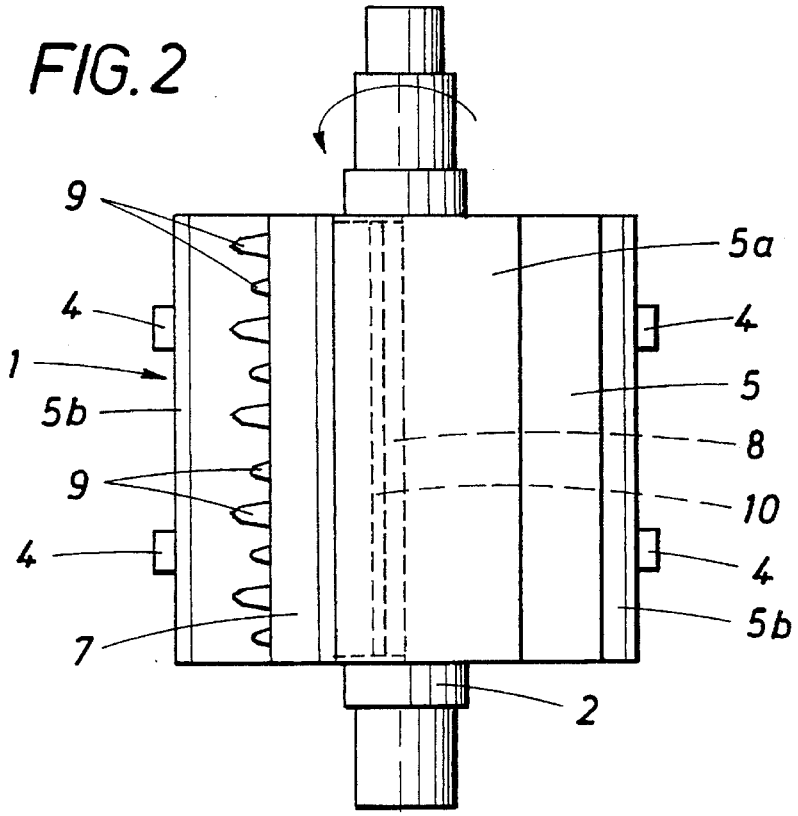

In the illustrative embodiment shown in FIGS. 1 and 2 a body of a rotor 1 of a disintegrating machine, which is not shown in more detail and consists, e.g., of an impact crusher, comprises a hub tube 3, which is connected to a drive shaft 2 and to which peripherally spaced apart, radial cheeks 4 are welded, and axial backing plates 5, 5*a* and 5' disposed between adjacent cheeks 4. The backing plates 5 and one of the backing plates 5*a* extend between the cheeks 4 at a distance from the hub tube and are welded to cheeks 4, and the other backing plates 5*a* and backing plates 5' are partly welded to hub tube 3 and partly to cheeks 4 so that the rotor structure is relatively light in weight and yet stable. Receptacles 6 for supporting beater bars 7, which are parallel to the axis of the rotor, are defined in the rotor 1 by suitable recesses in the cheeks 4 and by suitably arranged backing plates 5*a*. Each beater bar 7 consists of a bar body 7*a* and a retaining extension 8 and has a cross-section which is symmetrical to a plane of symmetry S extending along the longitudinal center line of the bar. The plane of symmetry S extends approximately in the direction of a tangent on the flight circle defined by the outer periphery of bar bodies 7*a* of rotating beater bars 7 and through the associated receptacle 6, which is open in the direction of rotation and receives the retaining extension 8 of the beater bar 7. On their leading side the bar bodies 7*a* have knife edges 9, which extend perpendicularly to the rotor axis and are contiguous to the flight circle, and these knife edges are also symmetrical to the plane of symmetry S and extend in planes which are normal to the axis of the rotor.

The rotor 1 contains two diametrically opposite beater bars 7. The cheeks 4, the backing plates 5, 5*a*, 5' and beater bars 7 occupy an area an elliptical configuration E, as seen in a top plan view. A satisfactory action of the beater bars 7 will be ensured, which will be effective at their leading surface and by the knife edges 9 without an adverse effect of the cross-section of the rotor. Besides, the beater bars will be fully backed throughout their length by the backing plates 5*a* and will thus be able to withstand high stresses and will have a high stability. Because mainly the radially outer half of each beater bar will strike on the material to be disintegrated, the inner half may be covered by suitable plates 5*b* affixed to backing plates 5', which serve to protect the bars, so that only one ball will be worn at a time and owing to the symmetry of the beater bars 7 their life can be prolonged simply by inverting the beater bars.

In the receptacles 6 of the rotor the beater bars 7 are positively locked by locking rods 10, which are parallel to the axis of the rotor. To that end the retaining extensions 8 have longitudinally extending grooves 11 and the receptacles 6 define mating surfaces 12 for backing the locking rods. For this reason the retaining extension 8 of each beater bar 7 can simply be inserted into the receptacle 6 from its leading side and can then positively be locked in the rotor 1 by inverting the locking rod 10. Conversely, when the locking rods 10 have been pulled out the beater bars 7 will be freely removable. As a result, the beater bars 7 can be changed with a few manipulations but are held in position and properly supported in the rotor 1.

In the other illustrative embodiments shown in FIGS. 3 to 8, identical parts are designated by the same reference characters and in order to avoid repetition will not be described again.

Figure 3:
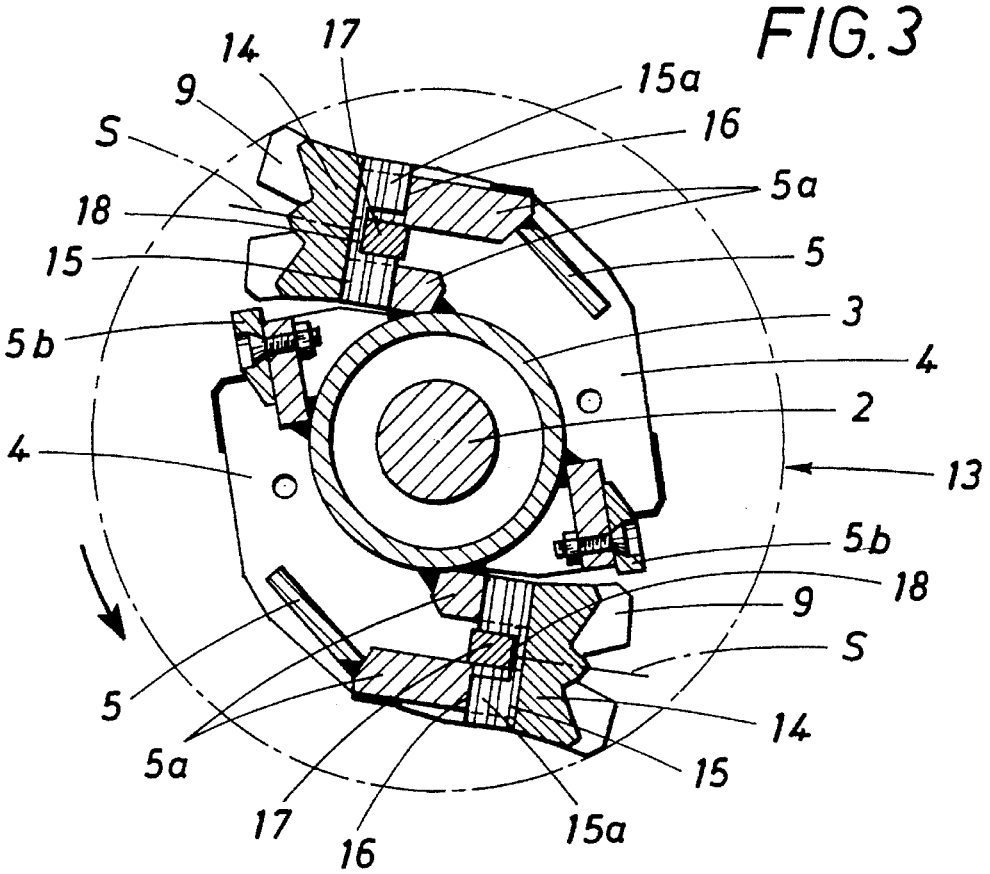
FIGS. 3 and 4 are, respectively, a transverse sectional view and a top plan view showing another illustrative embodiment of a rotor in accordance with the invention.
Figure 4:
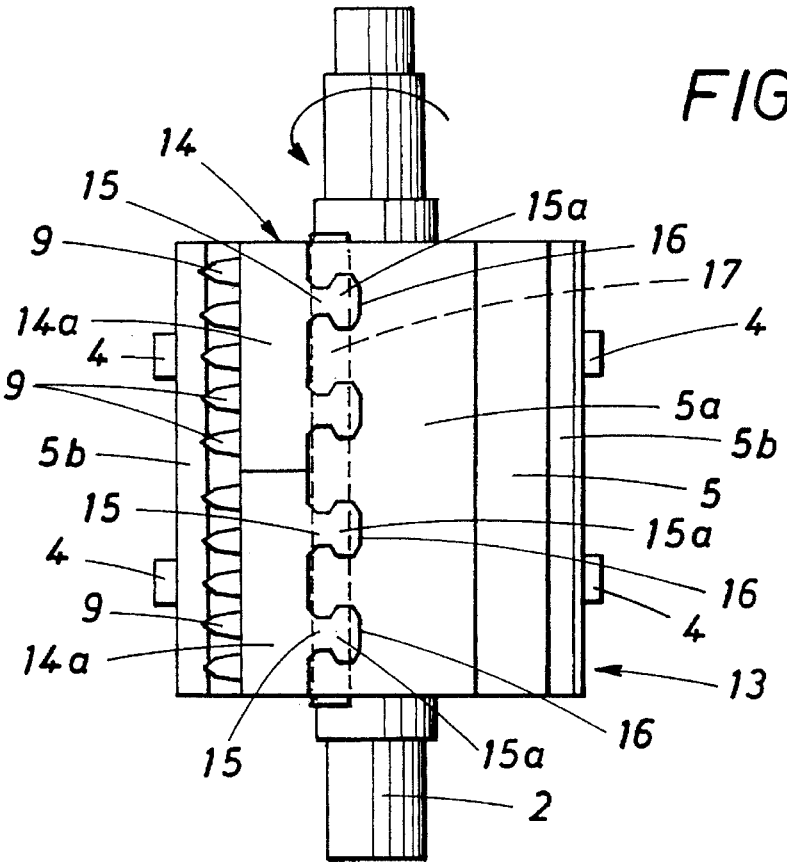

The rotor 13 shown in FIGS. 3 and 4 is designed like the rotor 1 shown in FIGS. 1 and 2 but the beater bars 14 instead of comprising a longitudinally extending retaining extension are formed with axially spaced apart, transversely extending retaining extensions 15 provided with a head portion 15*a*, which is enlarged in the shape of a mushroom. Those retaining extensions 15 of the beater bars 14 extend into approximately radially extending receiving grooves 16, which are formed in the receptacles 6 of the rotor and are undercut to fit the retaining extensions. For this reason the beater bars 14 must radially be inserted and a positive joint between the beater bars 14 and the rotor 13 will inherently be obtained. In that case the position is also fixed by a locking rod 17, which is parallel to the axis of the rotor and extends between the backing plates 5*a* of the receptacles 6 and along the plane of symmetry S of the beating bar 14 passes through grooves 18 of consecutive retaining extensions 15. The beater bars 14 are divided in length into two parts 14*a* and are locked by a common locking rod 17.

Figure 5:
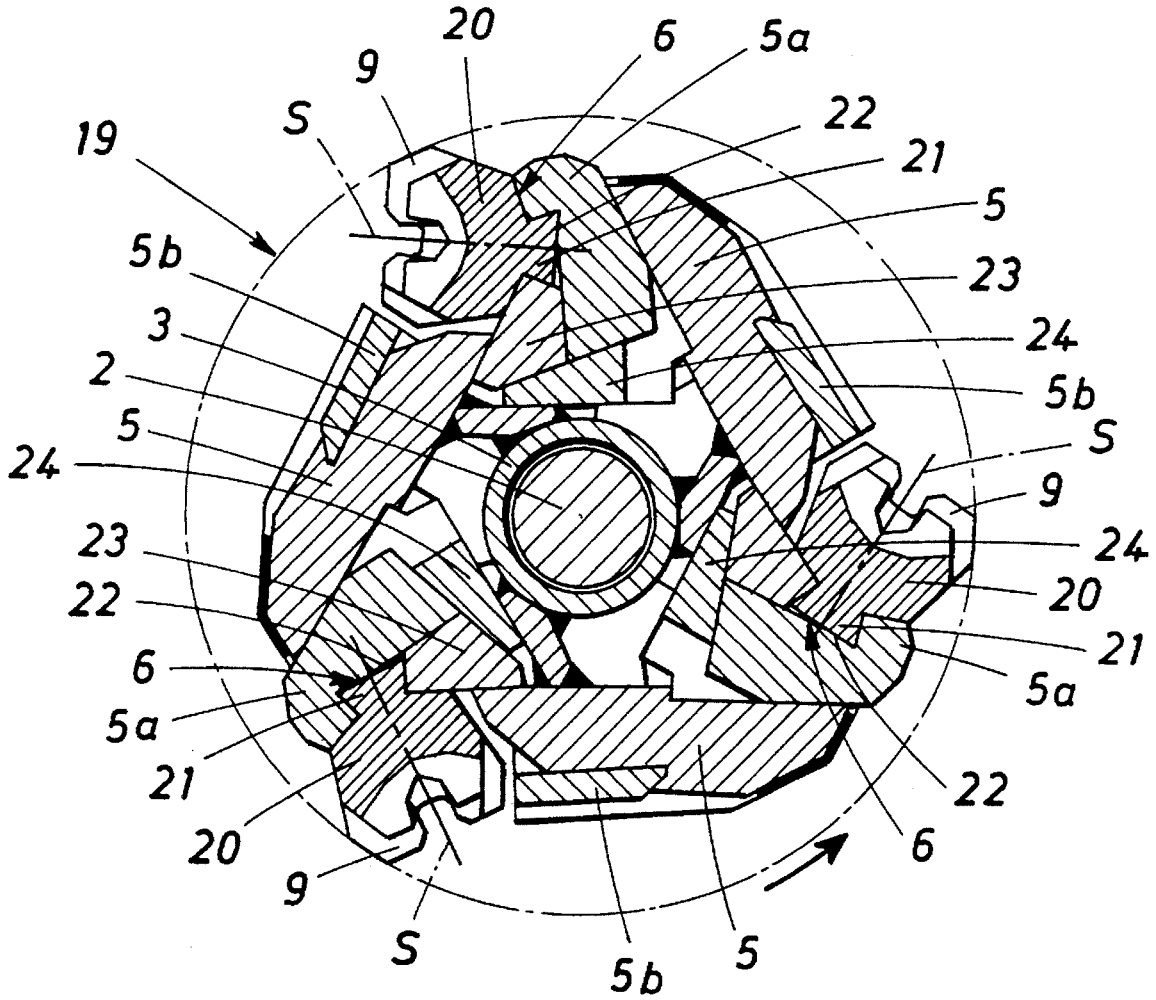
FIG. 5 is a transverse sectional view showing a further illustrative embodiment of a rotor in accordance with the invention.

In the illustrative embodiment shown in FIG. 5 the rotor 19 is provided with three beater bars 20, which comprise retaining extensions 21, which are dovetail-shaped in cross-section and extend into correspondingly undercut receiving grooves 22 in the receptacles 6 of the rotor. In that case the beater bars 20 are wedged and clamped in position against the backing plates 5*a* in the receptacles by a backing member 23 and a merely slightly indicated wedge drive 24. The rotor 19 is a cylinder having flattened sides between adjacent beater bars 20 so that the leading side of each beater bar 20 is again free to act.

Figure 6:
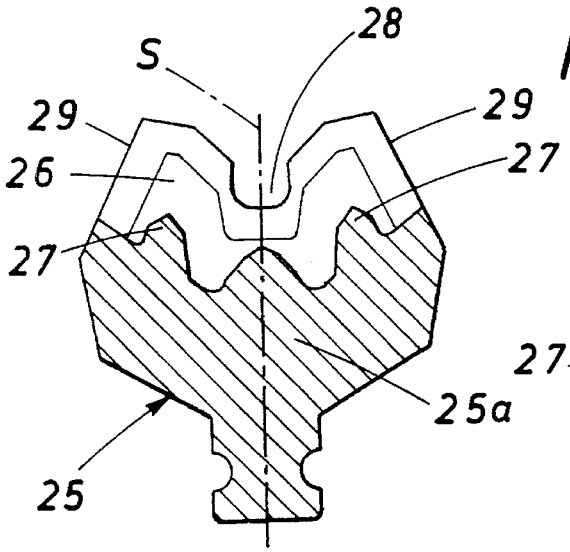
FIGS. 6, 7, 8, and 9 are transverse sectional views showing various embodiments of beater bars for rotors in accordance with the invention.
Figure 7:
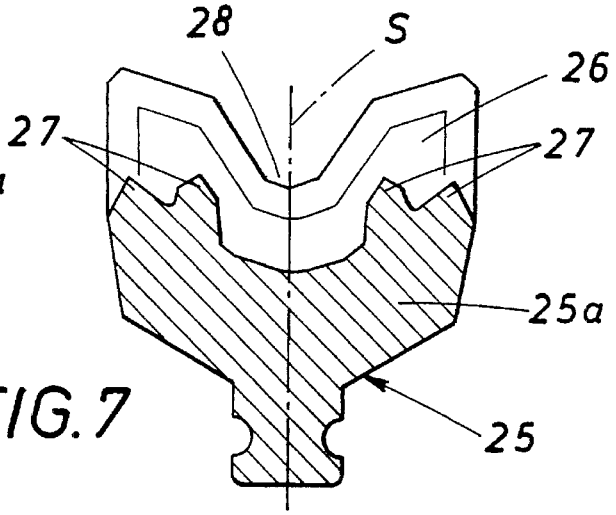

Beater bars having a symmetrical shape are inserted in the rotors in accordance with the invention and have knife edges, which extend in planes which are normal to the axis of the rotor when the beater bars have been inserted. As is apparent from FIGS. 6, 7, 8, and 9 it is possible to use beater bars which differ greatly in shape so that the beater bars and the disintegrating action can be adapted to widely different disintegrating tasks. The bar body 25*a* of the beater bar 25 shown in FIGS. 6 and 7 is approximately C-shaped in cross-section and between the axis-normal knife edges 26 comprises axially extending knife edges 27, which protrude to be contiguous to the flight circle of the rotor. Adjacent to the plane of symmetry S the axis-normal knife edges 26 are formed each with a U- or V-shaped recess 28, and they may have sloping portions 29 at their outer ends. This will result in a particularly strong cleaving action and in an improved impact and the wear of the knife edges of the beating bars 25 will be restricted in use to one-half of the bar at a given time so that the beater bars can be used twice because they can be inverted.

Figure 8:
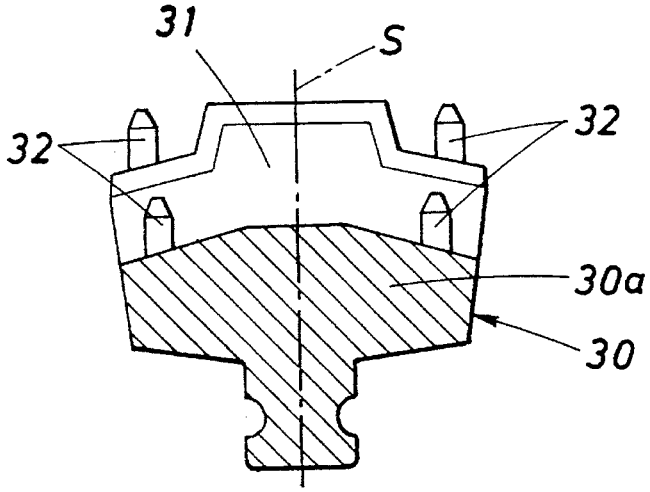

In the beater bar 30 shown in FIG. 8, chisellike beater spikes 32, which protrude to be contiguous to the flight circle of the rotor, are formed on the bar body 30*a* and the axis-normal knife edges 31 so that special striking and cleaving actions will be achieved.

Figure 9:
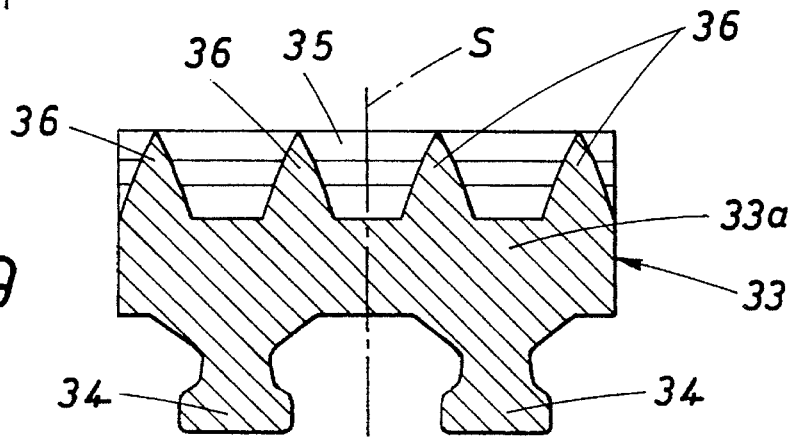

As is indicated in FIG. 9, a beater bar 33 may be used in which the bar body 33*a* is provided with two parallel retaining extensions 34 and with axis-normal knife edges 35 and axial knife edges 36, which cross in a grid pattern.

The rotor in accordance with the invention is simple in design and distinguishes by its high performance and high adaptability and for this reason can be used to disintegrate widely different materials and can optimally be adapted in its disintegrating action to the requirements in each case.

I claim:

1. In a rotor for use in a disintegrating machine, comprising a rotor body having an axis and a periphery, the rotor body being adapted to be rotated about said axis in a predetermined direction and provided at said periphery with a plurality of receptacles extending parallel to said axis, a plurality of beater bars, each of which has a bar body, which extends in a direction which is parallel to said axis and has a symmetrical cross-section, the bar body having at least one retaining extension supported in a respective one of said receptacles, the improvement residing in that each of said receptacles has on one side an opening facing in said predetermined direction, each of said bar bodies has a longitudinal plane of symmetry extending in a direction which is substantially parallel to a tangent to a flight circle defined by an outer periphery of the bar bodies of the beater bars upon rotation of the rotor body, and each of said bar bodies is provided with axially spaced apart knife edges, which protrude at the periphery to be contiguous to said flight circle and are symmetrical to said plane of symmetry and extend in planes which are normal to said axis.

2. The improvement set forth in claim 1, wherein each of said knife edges has a recess adjacent to said plane of symmetry.

3. The improvement set forth in claim 1, wherein each of said knife edges is interrupted adjacent to said plane of symmetry.

4. The improvement set forth in claim 1, wherein each of said bar bodies is provided between adjacent ones of said knife edges with axially extending knife edges, which protrude to be contiguous to said flight circle.

5. The improvement set forth in claim 1, wherein said knife edges are provided with striking spikes, which protrude to be contiguous to said flight circle.

6. The improvement set forth in claim 1, wherein said bar bodies are provided with striking spikes, which protrude to be contiguous to said flight circle.

7. The improvement set forth in claim 1, wherein each of said knife edges has outer ends sloping toward said bar body.

8. The improvement set forth in claim 1, wherein said retaining extensions are formed with longitudinally extending grooves extending parallel to said axis, said rotor comprises backing means defining said receptacles, and each of said receptacles contains a locking rod extending in one of said grooves along the same and contacts and conforms to said backing means to lock one of said beater bars in said receptacle.

9. The improvement set forth in claim 8, wherein said receptacles are defined by approximately radially extending, undercut receiving grooves, and each of said beater bars is formed with transversely extending retaining extensions, which have enlarged head portions fitting said undercut grooves.

10. The improvement set forth in claim 9, wherein said rotor comprises backing means having receptacle-defining surfaces which define said receptacles, said transversely extending retaining extensions and said receptacle-defining surfaces are formed with grooves, which extend along said plane of symmetry of the associated bar body, and said locking rods fit said grooves.

11. The improvement set forth in claim 9, wherein said rotor comprises backing means having receptacle-defining surfaces which define said receptacles, said transversely extending retaining extensions and said receptacle-defining surfaces are formed with openings, which extend along said plane of symmetry of the associated bar body, and said locking rods fit said openings.

12. The improvement set forth in claim 1, wherein said receptacles are defined by approximately radially extending, undercut receiving grooves, and each of said beater bars is formed with transversely extending retaining extensions, which have enlarged head portions fitting said undercut grooves.

13. The improvement set forth in claim 1, wherein said rotor body comprises a plurality of peripherally spaced apart radial cheeks, axially extending backing plates are provided between adjacent ones of said cheeks, and said receptacles are defined by said cheeks and said backing plates.

14. The improvement set forth in claim 13, wherein said rotor has basically the shape of a cylinder of a substantially elliptical cross-section.

* * * * *